US008056549B1

(12) United States Patent
Fleetwood

(10) Patent No.: US 8,056,549 B1
(45) Date of Patent: Nov. 15, 2011

(54) CONCRETE PAVEMENT TEXTURING HEAD

(75) Inventor: Jonathan T. Fleetwood, Blythewood, SC (US)

(73) Assignee: Husqvarna Construction Products North America Inc., Olathe, KS (US)

( * ) Notice: Subject to any disclaimer, the term of this patent is extended or adjusted under 35 U.S.C. 154(b) by 0 days.

(21) Appl. No.: 13/041,141

(22) Filed: Mar. 4, 2011

(51) Int. Cl.
*B28D 1/04* (2006.01)

(52) U.S. Cl. ..... 125/15; 125/13.01

(58) Field of Classification Search ..... 125/15, 125/13.01, 38, 39; 451/541, 542, 543, 547
See application file for complete search history.

(56) References Cited

U.S. PATENT DOCUMENTS

| | | | | |
|---|---|---|---|---|
| 3,269,775 | A | 8/1966 | Hatcher | |
| 3,306,669 | A * | 2/1967 | Christensen et al. | 299/40.1 |
| 3,376,673 | A * | 4/1968 | Metzger et al. | 451/342 |
| 3,554,606 | A | 1/1971 | Mabey et al. | |
| 3,585,761 | A * | 6/1971 | Hughes et al. | 451/544 |
| 3,605,579 | A | 9/1971 | Heltzel | |
| 3,612,611 | A | 10/1971 | Ellis | |
| 3,779,607 | A * | 12/1973 | Staab | 299/39.4 |
| 3,788,704 | A | 1/1974 | Staab | |
| 3,801,211 | A | 4/1974 | Perkins | |
| 3,874,806 | A | 4/1975 | Grist et al. | |
| 3,902,760 | A | 9/1975 | Ellis | |
| 4,174,184 | A | 11/1979 | Heenan | |
| 4,333,685 | A | 6/1982 | Arnswald | |
| 4,456,303 | A | 6/1984 | Due | |
| 4,516,808 | A | 5/1985 | Staab et al. | |
| 4,623,277 | A | 11/1986 | Wayne et al. | |
| 4,743,140 | A | 5/1988 | Maletic | |
| 4,896,995 | A | 1/1990 | Simmons | |
| 4,900,094 | A | 2/1990 | Sergeant | |
| 4,904,024 | A | 2/1990 | Wiley | |
| 5,083,839 | A | 1/1992 | Younger | |
| 5,116,162 | A | 5/1992 | Burhite | |
| 5,161,910 | A | 11/1992 | O'Konek | |
| 5,176,426 | A | 1/1993 | Adamson | |
| 5,354,146 | A | 10/1994 | O'Konek | |
| 5,388,893 | A | 2/1995 | Maxwell et al. | |
| 5,456,547 | A | 10/1995 | Thomas et al. | |
| 5,775,781 | A | 7/1998 | Sawtelle et al. | |
| 5,893,677 | A | 4/1999 | Haehn et al. | |
| 6,110,031 | A * | 8/2000 | Preston et al. | 451/541 |
| 6,116,699 | A | 9/2000 | Kaczmarski et al. | |
| 6,142,139 | A * | 11/2000 | Lupi | 125/15 |
| 6,210,071 | B1 | 4/2001 | McSharry | |
| 6,499,809 | B1 | 12/2002 | O'Konek | |
| 6,612,773 | B2 | 9/2003 | Gray | |

(Continued)

FOREIGN PATENT DOCUMENTS

DE 102008006426 A1 8/2009

(Continued)

*Primary Examiner* — Robert Rose
(74) *Attorney, Agent, or Firm* — Novak Druce + Quigg LLP

(57) ABSTRACT

The present disclosure presents a substantially cylindrically-shaped pavement texturing head. The pavement texturing head can include a plurality of substantially round, disc-shaped grinding members adjacently arranged and substantially aligned, one with the others, along a common rotational center axis. Additionally, the grinding members establish a circumferential grinding zone around the pavement texturing head. Furthermore, the grinding zone includes a plurality of grinding segments collectively forming an exterior surface around the substantially cylindrically-shaped pavement texturing head and having an exposed peripheral profile taken parallel to the common rotational center axis comprising undulating ridges and troughs.

5 Claims, 9 Drawing Sheets

U.S. PATENT DOCUMENTS

| | | | |
|---|---|---|---|
| 6,682,261 | B1 | 1/2004 | Karamihas et al. |
| 6,733,086 | B1 | 5/2004 | McSharry et al. |
| 6,786,556 | B2 | 9/2004 | Due |
| 6,887,142 | B2 | 5/2005 | Rupprecht et al. |
| 7,073,975 | B2 | 7/2006 | Kraemer |
| 7,144,087 | B2 | 12/2006 | Haroldsen et al. |
| 7,281,878 | B2 | 10/2007 | Schulz |
| 7,413,376 | B2 | 8/2008 | Potts et al. |
| 7,419,328 | B2 | 9/2008 | Potts et al. |
| 7,588,483 | B1 | 9/2009 | Allen, Jr. et al. |
| 7,748,789 | B2 | 7/2010 | Freeburn |
| 7,837,276 | B2 | 11/2010 | Kraemer et al. |
| 2010/0109421 | A1 | 5/2010 | Kraemer |

FOREIGN PATENT DOCUMENTS

| | | | |
|---|---|---|---|
| EP | 955126 | B1 | 10/2002 |
| GB | 1373590 | A | 11/1974 |
| JP | 2003268714 | A | 9/2003 |
| KR | 865359 | B1 | 10/2008 |
| WO | 1991017315 | A1 | 11/1991 |
| WO | 2001016429 | A1 | 3/2001 |

* cited by examiner

CONCRETE PAVEMENT TEXTURING HEAD

FIELD

The present disclosure relates to pavement grinders and in particular to large scale pavement grinders.

BACKGROUND

Pavement diamond grinders are used for grinding concrete and asphalt surfaces. Grinding is done to remove irregularities in the road surface, to provide texture to the surface to reduce skidding, and also to groove the surface to facilitate water drainage. Grinding, texturing and grooving are used on pavement surfaces including highways, airport runways and bridge decks, at industrial plants, and at stock pens and barns.

The diamond tipped blades which are used to grind the concrete or asphalt surface are mounted on a rotating arbor. The arbor is mounted on an undercarriage of the grinder so that end portions of the arbor are supported by bearings. Conventional grinder can include end portions of the arbor which are mechanically driven by a system of belts and pulleys. The power supplied from the mechanical drive limits the torque supplied to the arbor.

The width of the cutting path affects the time required to perform the grinding or grooving work. When grinding and grooving are performed, adjoining cuts must be precisely aligned to ensure proper cutting depth and an even pavement surface.

BRIEF DESCRIPTION OF THE FIGURES

Implementations of the present disclosure are now described, by way of example only, with reference to the attached Figures, wherein.

DETAILED DESCRIPTION

Figure 1:
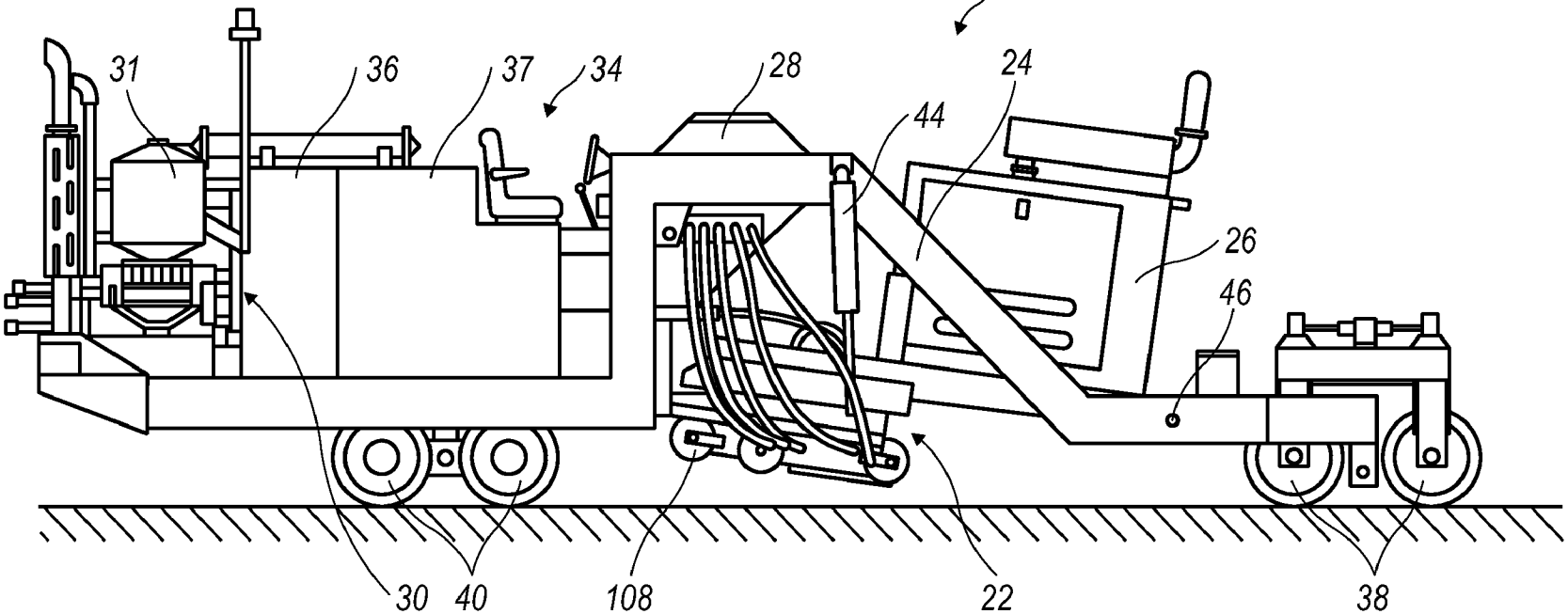
FIG. 1 illustrates an exemplarily concrete grinder having a pavement texturing head according to an embodiment of the present disclosure.

It will be appreciated that for simplicity and clarity of illustration, where considered appropriate, reference numerals may be repeated among the figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures and components have not been described in detail so as not to obscure the embodiments described herein. Also, the description is not to be considered as limiting the scope of the embodiments described herein. While examples of dimensions have been provided, other embodiments can be implemented that include other dimensions.

The present embodiments include a substantially cylindrically-shaped pavement texturing head. Pavement as used herein can refer to any surface including but not limited to concrete and asphalt. The pavement texturing head can include a plurality of substantially round, disc-shaped grinding members adjacently arranged and substantially aligned, one with the others, along a common rotational center axis. Additionally, the grinding members establish a circumferential grinding zone around the pavement texturing head. The substantially cylindrically-shaped pavement texturing head has an average diameter of at least eight inches and a length measured along the common rotational center axis. Furthermore, the grinding zone includes a plurality of grinding segments collectively forming an exterior surface around the substantially cylindrically-shaped pavement texturing head and having an exposed peripheral profile taken parallel to the common rotational center axis comprising undulating ridges and troughs. In at least one embodiment an average distance between peaks of adjacent ridges ranges from about 0.04 to about 0.2 inches.

In at least one embodiment, the exposed peripheral profile of the grinding segments includes undulating ridges and troughs that are substantially sinusoidally shaped. Additionally, in at least one embodiment, an average difference in radial height between adjacent ridge peaks and trough valleys measures from about 0.02 to about 0.1 inches. In yet another embodiment, the circumferential grinding zone around the pavement texturing head extends along a substantial majority of the length of the texturing head. In still a further embodiment, the materials of construction of the grinding segments have a higher concentration of diamond particulate in the region of ridge peaks and in area in a substantially radial direction beneath the ridge peaks as compared to that of the trough valleys and in a substantially radial direction beneath the trough valleys.

The present disclosure also contemplates the implementation of one or more mechanisms and components as described herein. For example, the pavement texturing head can include one or more cutting members. Additionally, the grinding segments can have different profiles as discussed herein. The diameter of the pavement texturing head can be adjusted based on the pavement grinder and/or type of material that the pavement grinder is configured to grind.

The pavement texturing head can be constructed to be implemented on a pavement grinder or other machine that is designed for grinding and/or grooving of the pavement. An example of such a pavement grinder is presented herein, but the present disclosure is not limited to any one grinder and can be used on a variety of different grinders that are configured for use with a pavement texturing head.

The present disclosure also contemplates a method of producing a concrete surface using a pavement texturing head as provided herein. In other embodiments, the pavement texturing head can be used for asphalt or other surfaces.

Referring now to the drawings, and referring in particular to FIG. 1, a pavement grinder, generally designated 20 is shown. The grinder 20 requires a large volume of water and pulls a water tank (not shown). The grinding and/or grooving occurs at the grinding carriage 22 which is supported by a frame 24. The grinder 20 is driven by an engine 26, for example a diesel engine, which also supplies power for other systems. Debris generated by grinding is suctioned up to a separation tank 28 with suction from a vacuum unit 30 having a blower 31.

While grinding, an operator walks beside the grinder 20 or sits at an elevated position at control station 34 above an oil tank 37 which is adjacent to a fuel tank 36. The grinding can be monitored by the operator so that proper cutting depth is maintained for an even finished surface and so that the cut is aligned with the previous cuts. In at least one configuration, the grinding can be monitored at the control station 34 via cameras and monitors. The grinder 20 has forward drive wheels 38 and rear drive wheels 40 which propel the grinder 20 during grinding and provide a long wheelbase for smoother travel at the carriage 22.

Figure 2:
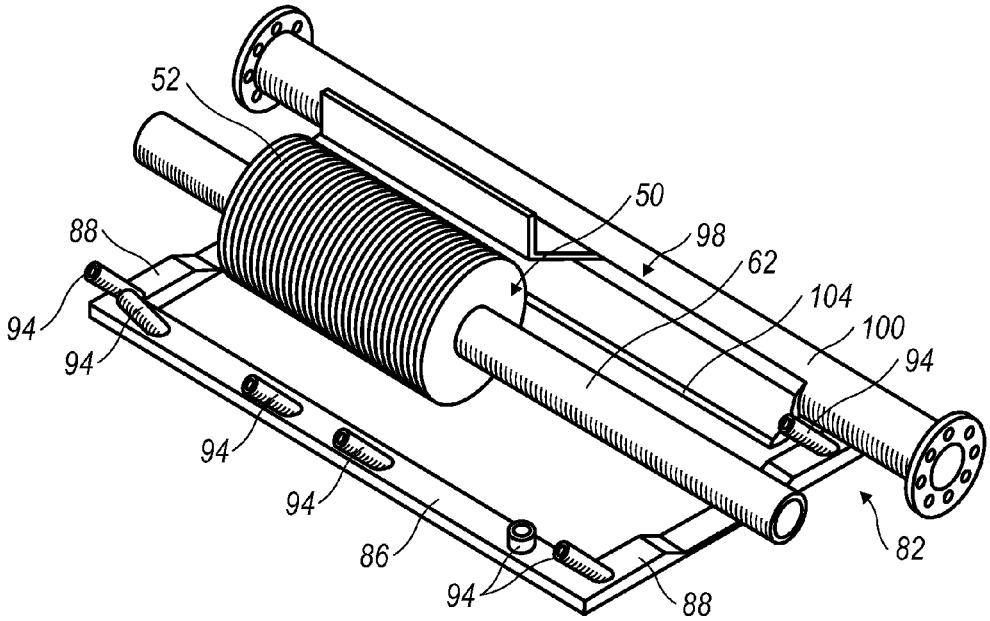
FIG. 2 illustrates an exemplarily pavement texturing head and grinder arbor according to an embodiment of the present disclosure.

As shown in FIG. 1, the grinding carriage 22 is raised or lowered by carriage lift mechanism 44 attaching to the frame 24. The carriage 22 lowers from a nonuse position, as shown in FIG. 1, to a desired cutting depth position for grooving and grinding. The carriage 22 is also adjusted vertically to change the cutting depth by raising and lowering adjustment wheels 108 relative to the carriage. The carriage 22 pivots up and down about hinge 46 shown in FIG. 1. In addition, water spraying, arbor driving, and debris removal apparatus are supported by the carriage 22 and rise and descend with the carriage. The carriage 22 supports a cutting arbor 50 having an arbor shaft 62 with a multiplicity of radial blades 52 mounted side by side thereon, as shown in FIG. 2. Another example of cutting arbor is described in relation to FIGS. 6-7, wherein the pavement texturing head 260 according to the present disclosure is presented. The pavement texturing head 260 can be implemented in place of cutting arbor 50. In one embodiment, the blades 52 define a cutting surface four feet wide.

Figure 3:
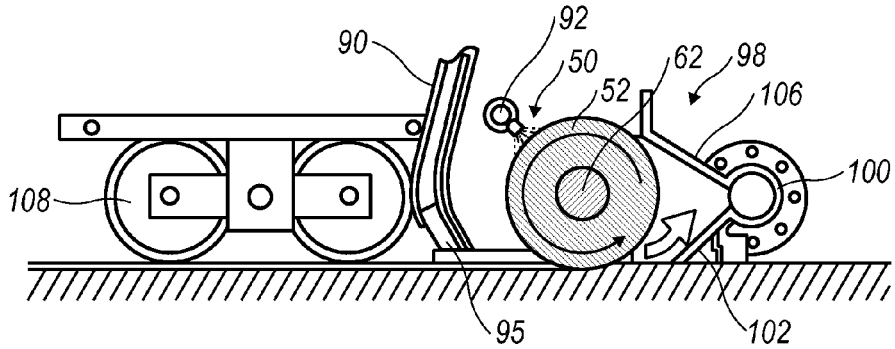
FIG. 3 illustrates section view of the exemplarily concrete grinder of FIG. 1.

As shown in FIGS. 2 and 3, vacuum intake system 82 includes a rear suction bar 86, side suction bars 88 and a forward intake shroud 98 surrounding the blades 52. The intake shroud 98, the rear suction bar 86, and the side suction bars 88 are supported on the grinding carriage 22 and are raised and lowered with the grinding carriage 22. The rear bar 86 attaches to the side suction bars 88 and drag on the ground around and behind the arbor 50 as the grinder 20 travels. The rear bar 86 and side bars 88 have a number of hose fittings 94 distributed across the top of the suction bars. Hoses 90 leading from the fittings 94 to carry the debris away. The hose fittings 94 correspond to nozzles 95 located on the bottom of the rear bar 86 and side bars 88 suctioning debris from the ground. The shroud 98 along with the side suction bars 88 and the rear suction bar 86 remove the debris from the grinding area and prevent the debris from being scattered away from the grinding area and left on the pavement surface.

Since the blades 52 generally rotates so that the leading edge is rotating upward, it is necessary to remove the debris that is thrown before the arbor 50, as well as the debris left in the path of the arbor 50. The shroud 98 prevents debris from being scattered forward and outward and directs the debris toward the vacuum suction. The intake shroud 98 assists in stopping debris, from being kicked forward from the blades 52 during grinding and directs the debris toward a duct 100 running parallel to the arbor. The intake shroud 98 includes a lower deflector plate 102 directing the debris forward and upward and an upper deflector plate 106 which assists in preventing the debris from being thrown up into the carriage 22. Together, the lower deflector plate 102 and upper deflector plate 106 funnel debris toward duct 100. The duct 100 then conveys the debris to hoses 92 at the ends of the duct 100, which deliver the debris to the separation tank 28 as shown in FIG. 1. The intake shroud 98 also has a flap 104 dragging on the ground which directs the debris onto the lower deflector plate 102 to reduce dust and assist in preventing debris from scattering forward under the lower deflector plate 102.

Figure 4:
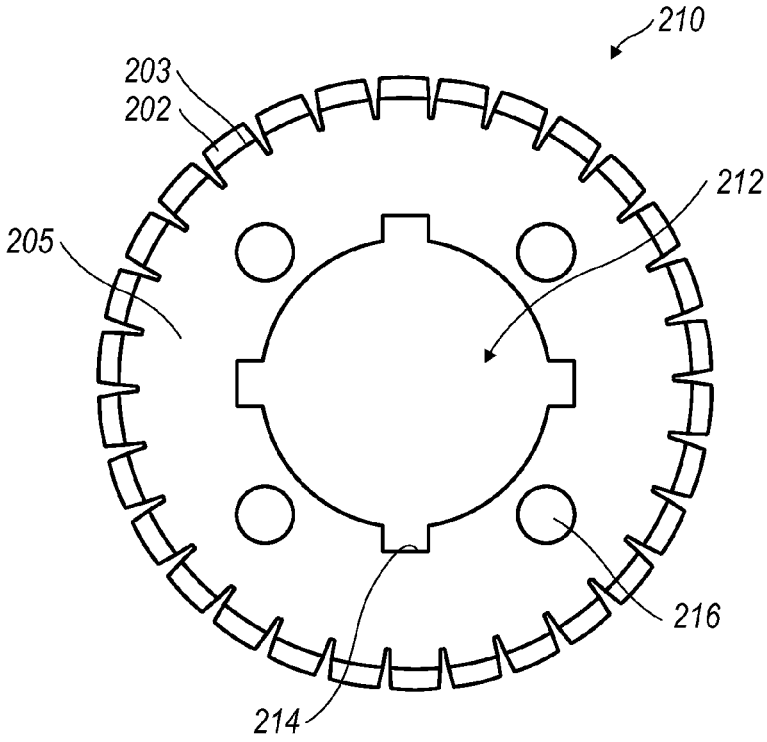
FIG. 4 illustrates an exemplarily grinding member having a plurality of cutting segments coupled thereto according to an embodiment of the present disclosure.

FIG. 4 illustrates a grinding member 210 according to an exemplarily embodiment of the present disclosure. The grinding member 210 can be used in place of one or more of the blades 52 as described above. The grinding member 210 has a plurality of grinding segments 202 coupled about a central disc 205. The grinding segments 202 can have a thickness, in the direction into and out of the page, about equal to or greater than that of the central disc 205. The grinding segments 202 can be welded at 203 to the central disc 205. In other embodiments, the grinding segments 202 can be bonded to the central disc using other methods. The central disc 205 can be shaped to be mounted on an arbor such as the one described above or the one as illustrated in FIG. 6. An arbor through hole 212 is formed in the central disc 205 to accommodate an arbor. As illustrated, the through hole 212 is circular with a plurality of rectangular regions 214 extending radially from the perimeter of the circular region and openings 216. The rectangular regions 214 or through openings 216 or both may be used in mounting to the pavement grinder 20 and both these and the through hole 212 can be other shapes and sizes depending on the pavement grinder 20. In at least one embodiment, the rectangular regions 214 or through openings 216 can be omitted.

Figure 5:
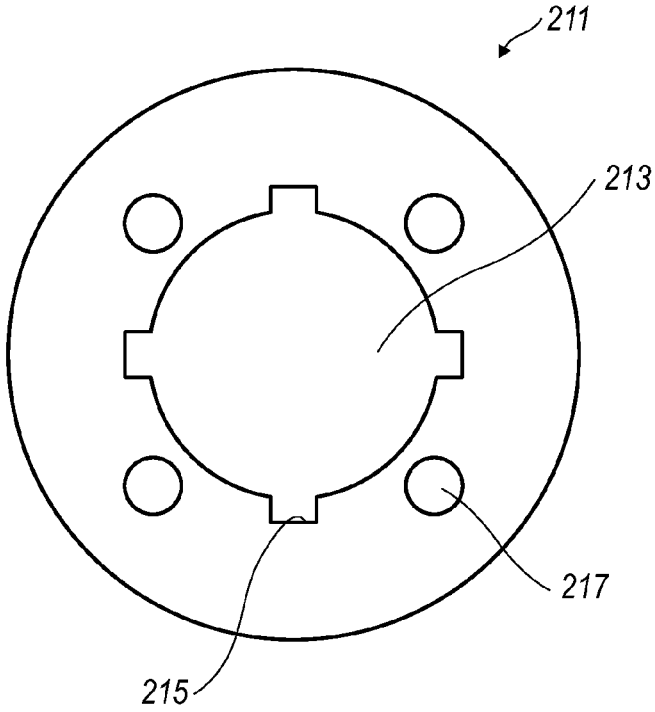
FIG. 5 illustrates an exemplarily spacer according to an embodiment of the present disclosure.

In at least one embodiment, the pavement texturing head 260 can include one or more spacers 211 as illustrated in FIG. 5. The spacer 211 can have a thickness, into and out of the page, that is substantially equal to the difference in the thickness of the central disc 205 and the thickness of the grinding segments 202, thereby allowing the grinding segments 202 of adjacent grinding members to substantially abut one another. In other embodiments, the spacer 211 can have a thickness that is greater than the difference in the thickness of the central disc 205 and the thickness of the grinding segments 202, thereby providing a gap between the grinding segments 202 of adjacent grinding members 210.

Figure 6:
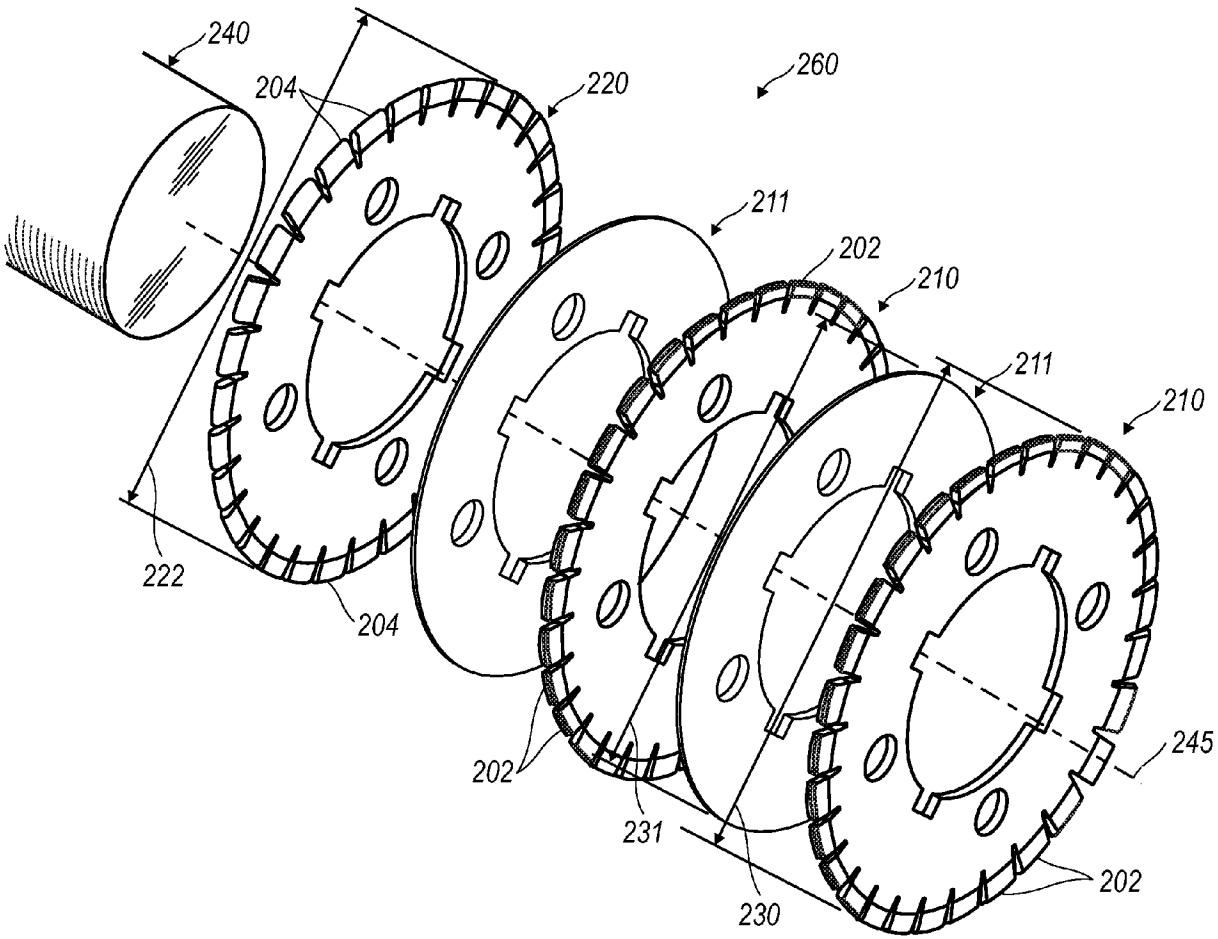
FIG. 6 illustrates an assembly view of an arbor, cutting member, a plurality of spacers and a plurality of grinding members according to an exemplarily embodiment of the present disclosure.

FIG. 6 illustrates an assembly view of a section of the pavement texturing head having a plurality of grinding members 210, a plurality of spacers 211 and a cutting member 220. The arbor 240 has rotational center axis 245, which forms a common rotational center axis of the pavement texturing head 260. As illustrated, from left to right, an arbor 240, a cutting member 220, a spacer 211, a grinding member 210, a spacer 211, and a grinding member 210 is shown. The cutting member 220 can be sized such that the outer diameter 222 including the cutting segments 204 is larger than the diameter 230 of the grinding member 210. For example the diameter 222 of the cutting member 220 can be 0.125 to 2 inches larger than the diameter 230 of the grinding member 210. This allows the cutting member to form a deeper groove in the concrete or other surface. This pattern can repeat in various configurations to comprise the entirety of the pavement texturing head. In one embodiment the cutting member 220 may also be excluded and the substantial entirety of the pavement texturing head may be comprised of the grinding member 210 and the spacer 211 typically in an alternating pattern. In another embodiment the pavement texturing head may also exclude the spacer and the substantial entirety of the pavement texturing head may be comprised of only the grinding member 210.

Figure 7A:
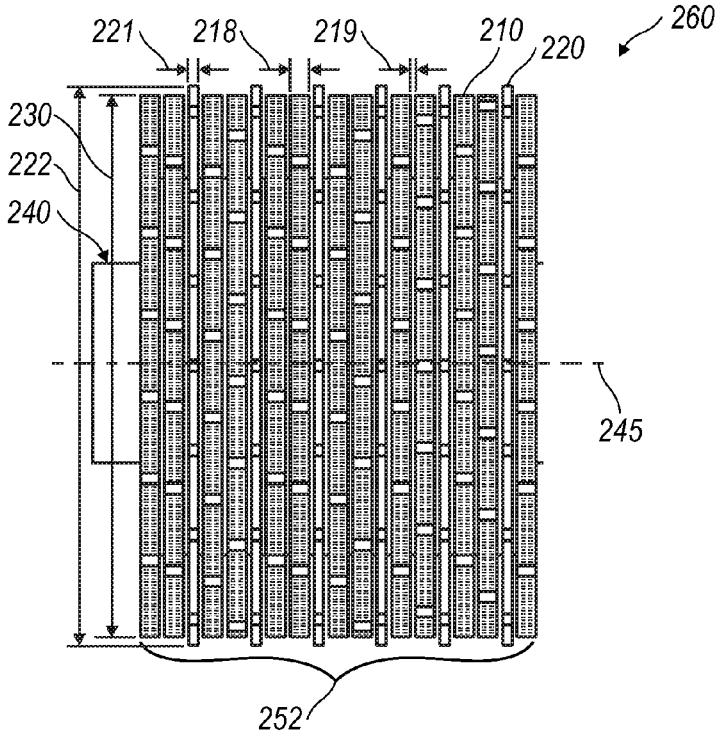
FIG. 7A illustrates an exemplarily grinding head according to a first embodiment of the present disclosure.
Figure 7B:
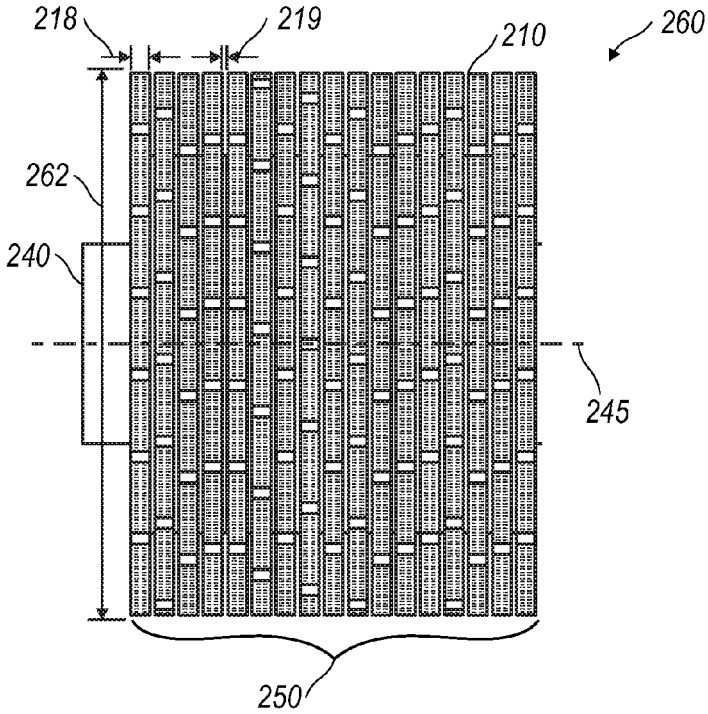
FIG. 7B illustrates an exemplarily grinding head according to a second embodiment of the present disclosure.

A further illustration of an exemplarily assembled pavement cutting heads 260 is presented in FIGS. 7A and 7B, having respective zones 252 and 250. In FIG. 7A, the exemplarily pavement texturing head 260 has a plurality of grinding members 210 and cutting members 220. The grinding members 210 and cutting members 220 establishing a circumferential grinding zone 252 around the pavement texturing head 260, said substantially cylindrically-shaped pavement texturing head having an average diameter 262 of at least eight inches and a length measured along the common rotational center axis 245. In at least one embodiment, the average diameter 262 is between about eight inches and about twenty-two inches.

As illustrated in FIG. 7A, the grinding zone 252 includes both cutting members 220 and grinding members 210. As illustrated, there are two rows of grinding members 210 encircling the arbor for every row of cutting members 220 encircling the arbor 240. In other embodiments, there can be three rows of grinding members 210 for each row of cutting members 220. In yet another embodiment, there can be a one to one correspondence between cutting members 220 and grinding members 210. In other embodiments, the ratio of cutting members 220 to grinding members can be more or less than described above. A couple of examples are presented herein below.

As shown, the pavement texturing head has two grinding members 210 for every cutting member 220. So from left to right the arrangement of grinding members 210 and cutting members 220 are arranged in a repeating pattern. For example as shown, the pavement texturing head has the following pattern: grinding member 210, grinding member 210, cutting member 220, grinding member 210, and grinding member 210, cutting member 220. In other embodiments as described above, the cutting member 220 can be omitted. Furthermore, the spacing of cutting members can be different than the one illustrated. For example, there can be one cutting member for every grinding member. In other examples, three grinding members or more can be included for every cutting member. As illustrated the cutting member 220 has a thickness of 221. The thickness 221 of the cutting member 220 can be between about 0.0625 and 0.25 inch. The grinding members 210 can be spaced apart from one another by the spacers 211 as described previously so that a gap 219 is formed between adjacent grinding members 210. The gap 219 can be between about 0.001 and 0.05 inch. In other embodiments, no gap can exist. Still further a gap similar to gap 219 can be formed between the cutting member 220 and the adjacent grinding members 210. Likewise, in at least one embodiment, no gap can be present between the cutting member 220 and the adjacent grinding members 210.

In FIG. 7B, the circumferential grinding zone 250 does not have any cutting members 220, but only has a plurality of grinding members 210. In at least one embodiment, the circumferential grinding zone 250 can make up a substantial entirety length 264 of the pavement cutting head 260. The pavement cutting head 260 can be between one foot and six feet in length. Additionally, a plurality of pavement cutting heads 260 can be implemented with a pavement grinder 20. The grinding segments 202 of the grinding member 210 can have a thickness 218. The thickness 218 can be between about 0.125 and 1 inch. In other embodiments, other thicknesses of the grinding segments can be implemented. A further illustration of one of the grinding segments 202 is presented in FIG. 9, below. The grinding members 210 can be spaced apart from one another by the spacers 211 as described previously so that a gap 219 is formed between adjacent grinding members 210. The gap 219 can be between about 0.001 and 0.05 inch. In other embodiments, no gap can exist as well.

Figure 8:
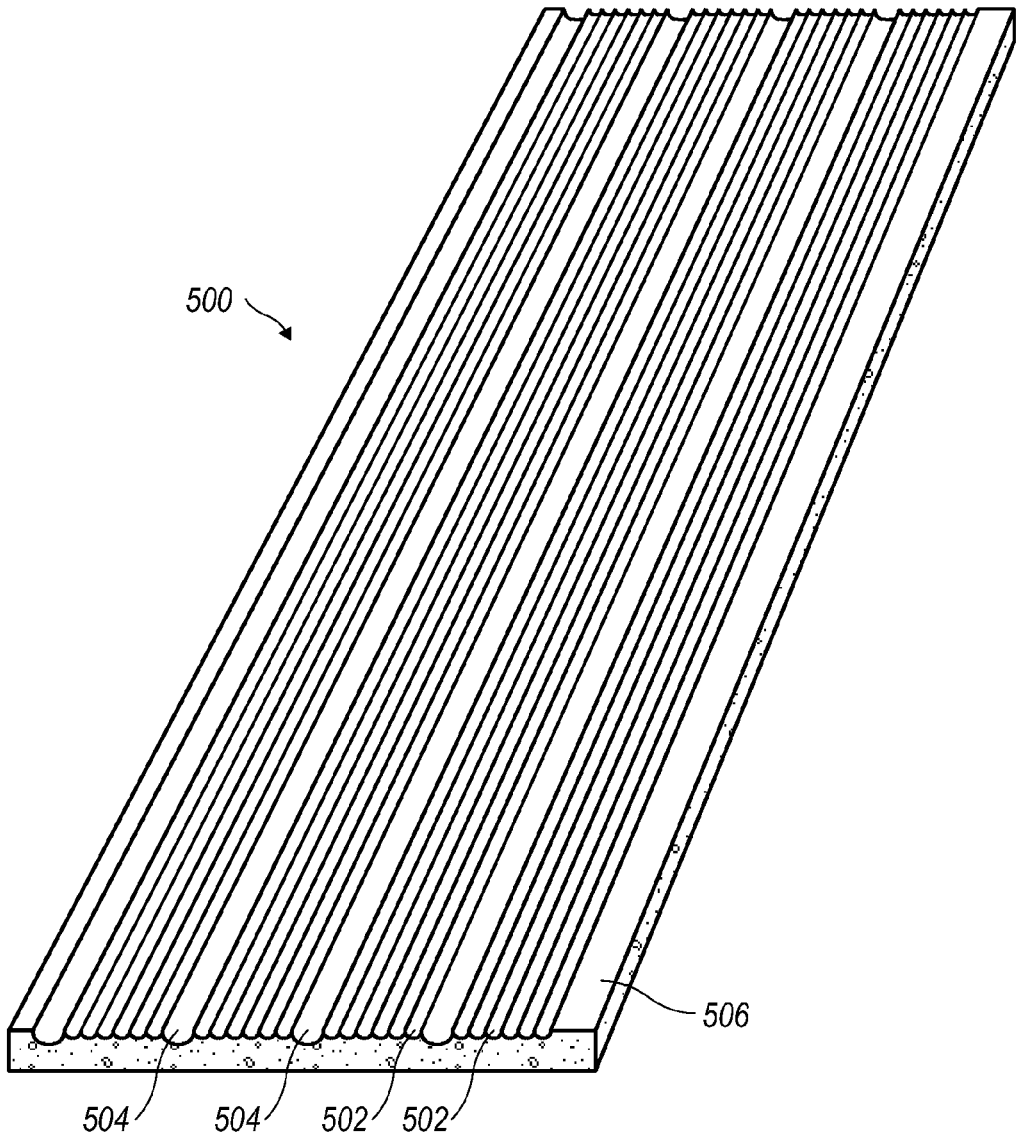
FIG. 8 illustrates an exemplarily concrete surface produced using an exemplary cutting head according to an embodiment of the present disclosure.

FIG. 8 illustrates an exemplarily concrete surface produced using the exemplarily pavement texturing head of FIG. 7A. As illustrated, the concrete surface 500 can be textured so that there are a plurality of deep troughs 504 and shallow troughs 502. As shown there are six shallow troughs 502 for every deep trough 504. This pattern results from having two grinding members 202 to each cutting member 204. The relationship between the widths and depths of the shallow troughs 502 and deep troughs 504 are described below. The troughs 502, 504 are recessed from the nominal concrete surface 506.

Figure 9:
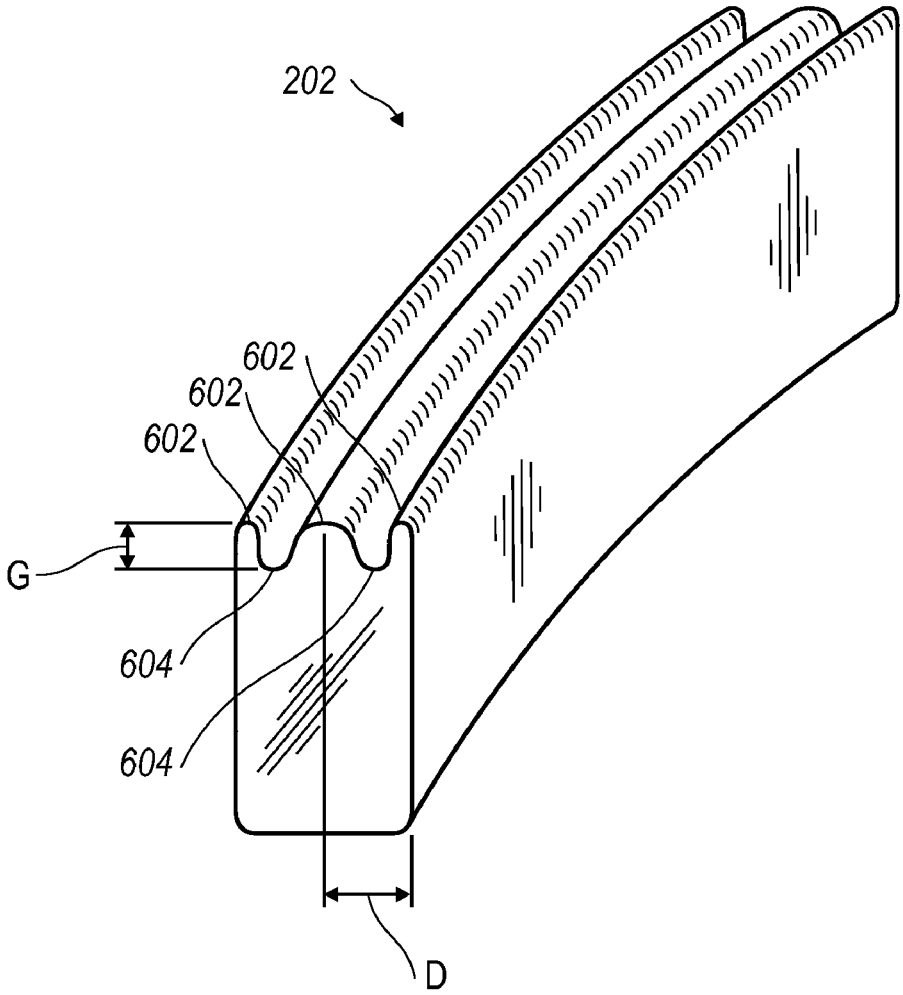
FIG. 9 illustrates an exemplarily grinding segment according to an embodiment of the present disclosure.

FIG. 9 illustrates an exemplarily grinding segment 202 having an exposed peripheral profile taken parallel to the common rotational center axis comprising undulating ridges 602 and troughs 604. As illustrated the grinding segment 202 has two troughs 604 and three ridges 602. In at least one embodiment, an average distance (D) between peaks of adjacent ridges 602 ranges from about 0.04 to about 0.2 inches. In other embodiments, an average distance (D) between peaks of adjacent ridges 602 ranges from about 0.04 to about 0.1 inches. In yet other embodiments, an average distance (D) between peaks of adjacent ridges 602 ranges from about 0.04 to about 0.0625 inches. Additionally in one embodiment, the depth (G) of the trough 604 in relation to the ridge 602 can be in the range of about 0.02 to about 0.1 inches. In another embodiment, the depth (G) of the trough 604 in relation to the ridge 602 can be in the range of about 0.02 to about 0.06 inches. In another embodiment, the depth (G) of the trough 604 in relation to the ridge 602 can be in the range of about 0.02 to about 0.04 inches. The grinding segment 202 with the troughs 604 and ridges 602 can be implemented as a grinding member as described above. The troughs 604 and ridges 602 can also be sinusoidally shaped as illustrated. In other embodiments, the troughs 604 and ridges 602 can have other types of shapes such as a square wave, a repeating wave, a random wave and the like. Additionally, the troughs 604 and ridges 602 can be shaped in an arrangement that is not wavy and the number of ridges and troughs can be more or less than illustrated. As described herein, the troughs 604 and ridges 602 are on individual grinding segments 202 which are mounted to one or more grinding members 210.

Figure 10:
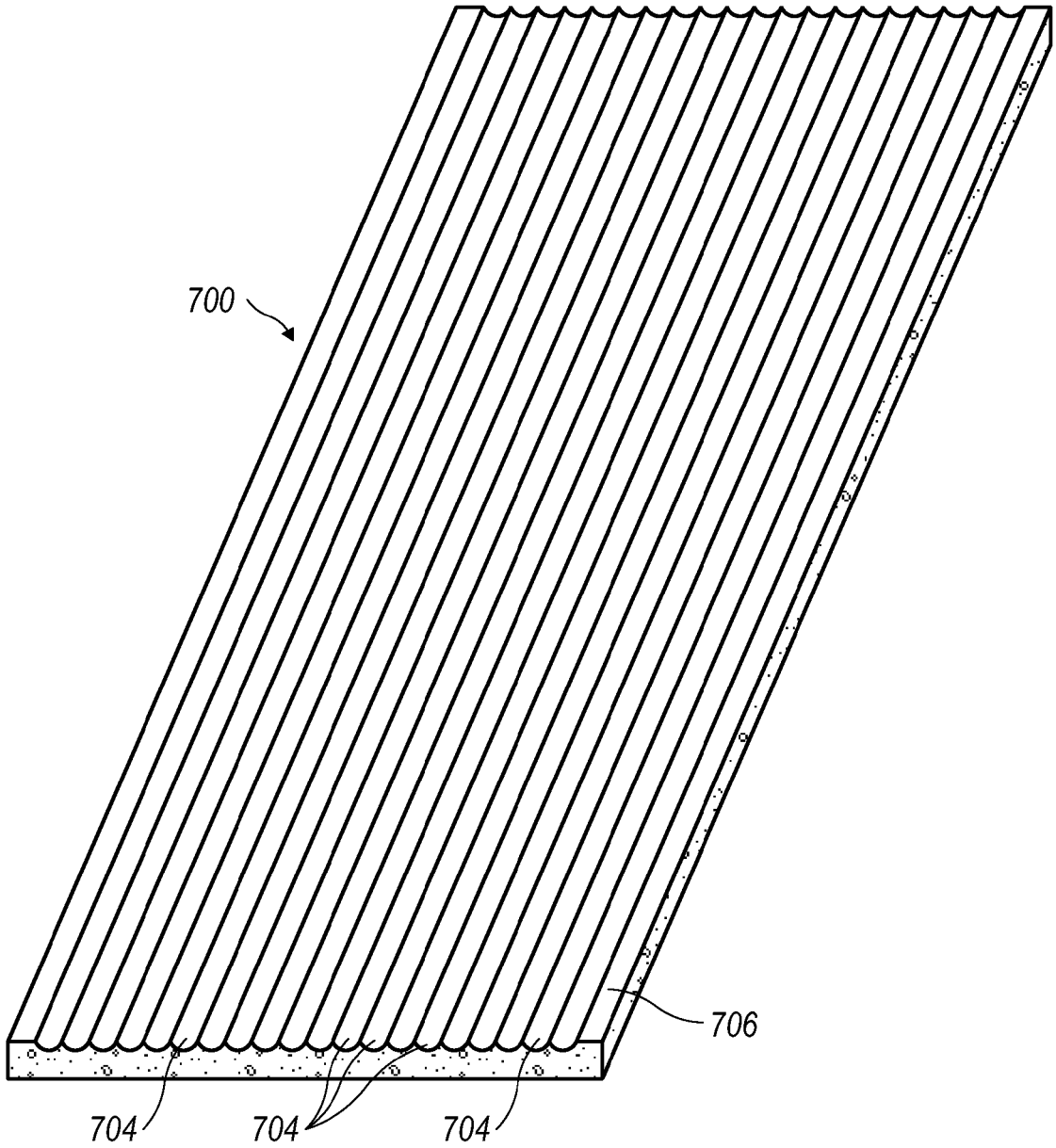
FIG. 10 illustrates another exemplarily concrete surface produced with a pavement texturing head having only a plurality of grinding members according to an embodiment of the present disclosure.

When the pavement texturing head 260 includes grinding members 210 but not cutting members 220, a concrete surface 700 such as the one illustrated in FIG. 10 can be produced. As illustrated the troughs 704 are of a uniform size with respect to the standard depth of the concrete surface 706. The positioning of the grinding segments 202 on the grinding members 210 allows for greater precision in forming the concrete surface as shown. Additionally, as the spacing between the ridges and troughs is small and the diameter of the grinding members 210 large, the control of the spacing is achieved using the segments 202 as described herein. Additionally, it allows for the grinding members 210 to substantially abut one another with little or no gap space as described above.

Figure 11:
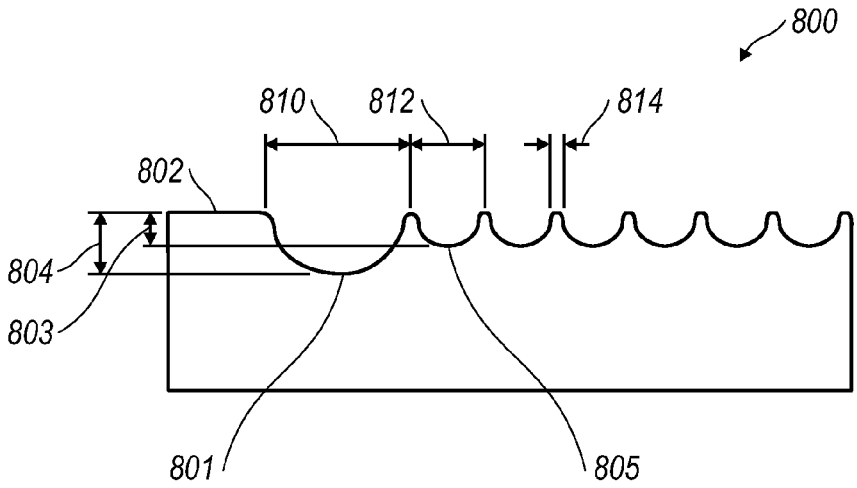
FIG. 11 illustrates a cross-section of an exemplarily concrete surface according to an embodiment of the present disclosure.
Figure 12:
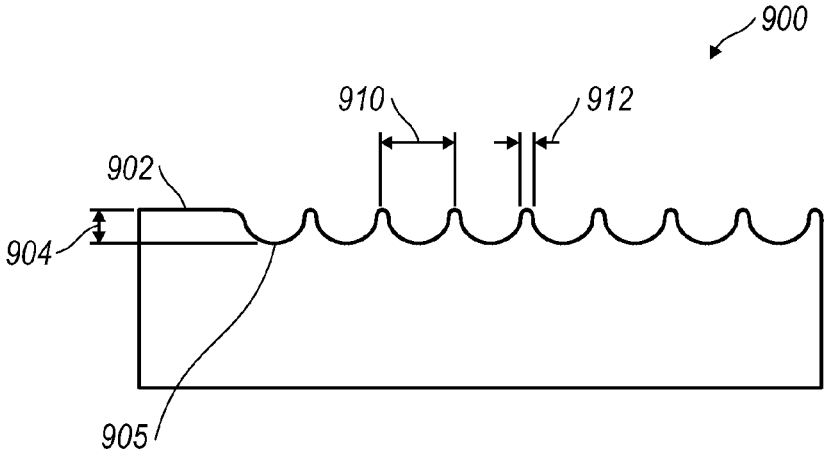
FIG. 12 illustrates another cross-section of an exemplarily concrete surface according to an embodiment of the present disclosure.

FIGS. 11 and 12 illustrate cross-sectional views of concrete formed using embodiments of the pavement texturing head as disclosed herein. In FIG. 11, a cross-section 800 of a concrete surface 802 is illustrated. As illustrated, a single deep trough 801 and six shallow troughs 805 are illustrated. The deep trough 801 has a depth 804 from the concrete surface 802. The depth 804 can be in the range of about 0.1 to 1 inch. The depth 803 of the shallow trough 805 can be in the range of about 0.02 to 0.1 inch. The width 810 of the deep trough 801 can be in the range of between about 0.125 and 0.25 inch. The width 812 of the shallow trough 805 can be between about 0.03 and 0.25 inch. The peaks can have a width 814 between about 0.005 and 0.01 inch.

In the illustrated example of FIG. 12, the troughs 905 of the concrete 900 have a uniform depth 904 below the concrete surface 902. The depth 904 of the troughs 905 can be between about 0.02 and 0.1 inch. The width 910 of the troughs 905 can be in the range between about 0.03 and 0.25 inch. The peaks can have a width 912 between about 0.005 and 0.01 inch.

As shown, the peaks and valleys of FIGS. 11 and 12 are sinusoidal shaped. In other embodiments, the peaks and valleys can be arranged so that they are generally undulating. For example, the peaks and valleys can be square wave shaped, irregularly shaped, randomly shaped or shaped in a repeating pattern.

Also, a method for producing concrete is presented below. The method can be implemented using one or more of the above described components. In a broad sense, the method includes grinding a surface using an embodiment or combination of embodiments of pavement texturing heads. The method includes configuring a pavement texturing head to have a plurality of grinding members each having one or more grinding segments mounted thereon. The plurality of grinding segments having undulating ridges and troughs, wherein an average distance between peaks of adjacent ridges ranges from about 0.04 to about 0.2 inches. Other distances between the peaks of adjacent ridges can be implemented as described herein. In at least one embodiment, the spacing between adjacent ridges is substantially uniform. In other embodiments, the spacing between adjacent ridges can vary.

The method can further include placing the pavement texturing head into contact with the surface such as a concrete surface or an asphalt surface. The method can further include moving the pavement texturing head along the surface so as to produce a corresponding textured surface. The textured surface can be one of the surfaces as described above.

A product by process is also contemplated; wherein, the product is a surface formed using an embodiment or combination of embodiments of steps of the method as described above.

Example embodiments have been described hereinabove regarding the implementation of a pavement texturing head. Various modifications to and departures from the disclosed example embodiments will occur to those having skill in the art. The subject matter that is intended to be within the spirit of this disclosure is set forth in the following claims.

The invention claimed is:

1. A substantially cylindrically-shaped pavement texturing head comprising:

a plurality of substantially round, disc-shaped grinding members adjacently arranged and substantially aligned, one with the each other, along a common rotational center axis;

said grinding members establishing a circumferential grinding zone around the pavement texturing head, said substantially cylindrically-shaped pavement texturing head having an average diameter of at least eight inches and a length measured along the common rotational center axis; and said grinding zone comprising a plurality of grinding segments, coupled to the grinding members, collectively forming an exterior surface around the substantially cylindrically-shaped pavement texturing head and said plurality of grinding segments having an exposed peripheral profile taken parallel to the common rotational center axis comprising undulating ridges and troughs and wherein an average distance between peaks of adjacent ridges ranges from about 0.04 to about 0.2 inches.

2. The pavement texturing head as recited in claim 1, wherein the exposed peripheral profile taken parallel to the common rotational center axis and comprising undulating ridges and troughs is substantially sinusoidally shaped.

3. The pavement texturing head as recited in claim 1, wherein an average difference in radial height between adjacent ridge peaks and trough valleys measures from about 0.02 to about 0.1 inches.

4. The pavement texturing head as recited in claim 1, wherein said circumferential grinding zone around the pavement texturing head extends along a substantial majority of the length of the texturing head.

5. The pavement texturing head as recited in claim 1, wherein the materials of construction of the grinding segments have a higher concentration of diamond particulate in the region of ridge peaks and in area in a substantially radial direction beneath the ridge peaks as compared to that of the trough valleys and in a substantially radial direction beneath the trough valleys.

* * * * *